US005324616A

United States Patent [19]

Sacripante et al.

[11] Patent Number: 5,324,616

[45] Date of Patent: Jun. 28, 1994

[54] ENCAPSULATED TONER COMPOSITIONS AND PROCESSES THEREOF

[75] Inventors: Guerino G. Sacripante, Oakville; Barkev Keoshkerian, Thornhill; Beng S. Ong, Mississauga, all of Canada

[73] Assignee: Xerox Corporation, Stamford, Conn.

[21] Appl. No.: 861,676

[22] Filed: Apr. 1, 1992

[51] Int. Cl.[5] ..... G03G 5/00; G03C 1/72

[52] U.S. Cl. ..... 430/137; 430/109; 430/138

[58] Field of Search ..... 430/137, 138, 109

[56] References Cited

U.S. PATENT DOCUMENTS

| | | | |
|---|---|---|---|
| 4,465,756 | 8/1984 | Mikami et al. | 430/138 |
| 4,629,489 | 12/1986 | Hirota et al. | 65/102 |
| 4,727,011 | 2/1988 | Mahabadi et al. | 430/138 |
| 4,797,339 | 1/1989 | Maruyama et al. | 430/109 |
| 4,816,366 | 3/1989 | Hyosu et al. | 430/137 |
| 4,977,052 | 12/1990 | Mikami | 430/98 |
| 4,996,127 | 2/1991 | Hasegawa et al. | 430/109 |
| 5,045,428 | 9/1991 | Sacripante et al. | 430/138 |

*Primary Examiner*—John Kight, III
*Assistant Examiner*—Richard Jones
*Attorney, Agent, or Firm*—E. O. Palazzo

[57] ABSTRACT

An in situ process for the preparation of encapsulated toner compositions which comprises dispersing a mixture of a cyclic olefin or cyclic olefins, pigments, dyes or mixtures thereof in an aqueous medium containing a surfactant thereby forming a stable microdroplet suspension, and thereafter adding a catalyst to effect a metathesis polymerization of the cyclic olefin or olefins to form the encapsulated toner resin.

19 Claims, No Drawings

ENCAPSULATED TONER COMPOSITIONS AND PROCESSES THEREOF

BACKGROUND OF THE INVENTION

The present invention is generally directed to toner processes, and more specifically to encapsulated toner processes, and toners thereof. In one embodiment, the present Invention is directed to a process for the preparation of encapsulated toner compositions by a shell-forming interfacial polycondensation and a core resin-forming metathesis reaction. Another specific embodiment of the present Invention relates to a process for the preparation of encapsulated toner compositions comprised of a core comprised of colorants, including pigments, dyes, or mixtures thereof, and a resin such as poly(nornbornene), poly(carbomethoxy nornbordiene), poly(dicyclopentadiene), poly(cyclooctene) obtained by metathesis or metal catalyzed polymerization of cyclic olefins which core is encapsulated in a polymeric shell comprised of, for example, a polyurea, a polyurethane, a polyamide, a polyester material, or mixtures thereof. In another embodiment of the present invention, there is provided a process for the preparation of an encapsulated toner composition comprised of a polymeric shell and a core comprised of colorants including pigments, dyes, mixtures thereof, and a polymer resin obtained by the metal catalyzed reaction of a cyclic olefin-functionalized reagent, such as cyclooctene, nornbornene, nornbordiene, dicyclopentadiene, 1,3-cyclopentylenevinylene, bicyclo[5,5,0]oct-2-ene, and silacyclopentene. In another specific embodiment of the present invention, there is provided an encapsulated toner process wherein the core resin is comprised of a polymer derived from the the metal catalyzed reaction of a cyclic olefin or acyclic olefin functionalized reagent.

Examples of advantages associated with processes of the present invention include the selection of different core resins unattainable by other suitable processes, and the utilization of a number of different colorants which are compatible with the metathesis reaction. Also, the metathesis reaction enables the core resin forming reaction of the present invention to be accomplished at ambient temperature of, for example, from about 20° C. to about 60° C. in some embodiments, thus reducing the energy cost associated therewith. With the core resin material obtained via the process of the present invention, the problem of image ghosting or hot-offset often observed in a number of ionographic printing systems or xerographic imaging systems is eliminated, or substantially minimized. In addition, the core resin of the present invention in embodiments is not leaky, that is the aforementioned core remains encapsulated and its defusion through the polymeric shell is avoided or minimized, thus eliminating or minimizing the problem of toner agglomeration associated with many encapsulated toner compositions. The toner compositions obtained by the process of the present invention in embodiments also display excellent powder flow characteristics and excellent toner transfer efficiency, for example over 99 percent in some embodiments from, for example, dielectric receivers or photoreceptors to paper substrate during the image development process. The process of the present invention can be utilized to formulate toner compositions for use in commercial ionographic printer machines such as, for example, the commercially available Delphax printers including the Delphax S9000 TM, S6000 TM, S4500 TM, S3000 TM, and Xerox Corporation printers including the Xerox Corporation 4060 and 4075 wherein, for example, transfixing is utilized. In another embodiment of the present invention, the toner process can be utilized to formulate toner compositions for use in commercial xerographic technologies, wherein image toning and transfer are accomplished electrostatically, and transferred images are fixed in a separate step by means of a pressure roll with or without the assistance of photochemical or thermal energy fusing, such as for example commercially available xerographic printers including the Xerox Corporation 5090, 1075, 1090, 1065, 5028, 1005.

The toner compositions of the present Invention can, in one embodiment, be prepared by first dispersing the precursor materials comprised of shell precursors, core resin precursors, colorants and metathesis catalysts into stabilized microdroplets of controlled droplet size and size distribution, and optionally followed by shell formation around the microdroplets via interfacial polymerization, and subsequently generating the core polymer resin by the metal catalyzed "metathesis" polymerization process within the newly formed microcapsules. Thus, in one embodiment the present invention is directed to a process for the simple, and economical preparation of pressure fixable encapsulated toner compositions by an interfacial polymerization/metathesis method wherein there are selected as the core resin precursors a cyclic olefin and a metal catalyst reagent capable of inducing and propagating the metatheis polymerization, a colorant, and a shell-forming monomer component or components capable of undergoing interfacial polymerization with another shell monomer component in the aqueous phase. Another specific embodiment of the present invention relates to the utilization of a metal catalyst such as tungsten hexachloride, molybdenum pentachloride or organocomplexes, such as trialkyl aluminum or dialkyl aluminum chloride complexes of rhodium halides, wherein alkyl contains, for example, from 1 to about 25 carbon atoms, such as methyl, ethyl, propyl, butyl, pentyl, hexyl, heptyl, octyl, nonyl, and the like, and a diolefinic or multiolefinic cyclic monomers as the core resin-forming precursors, the reaction of which via polymetathesis enables the desired core resin. Yet another specific embodiment of the present invention relates to the utilization of a diolefinic cyclic monomers as the core resin-forming precursors, the reaction of which via polymetathesis enables the desired core resin. A further specific embodiment of the present invention encompasses the use of a cyclic olefin such as norbornene or 3,3-dlmethylcyclopropene, or the use of cyclic diolefins such as cyclooctadiene or cyclopentadiene or multiolefins such as cyclooctatetrene as one of the core resin-forming precursors, the reaction of which affords the desirable core resin for the toner compositions of the present invention. Other process embodiments of the present invention relate to, for example, interfacial polymerization/metathesis reaction processes for obtaining encapsulated colored toner compositions. Further, in another process aspect of the present invention the encapsulated toners can be prepared without the interfacial shell forming component. Moreover, with the aforementioned process in an embodiment of the present invention there is obtained improved product yield per unit volume of reactor size since, for example, the extraneous solvent component can be replaced by a liquid core and shell precursors.

The aforementioned toners prepared in accordance with the process of the present Invention are useful for permitting the development of images in reprographic imaging systems, inclusive of electrostatic imaging processes wherein pressure fixing, especially pressure fixing in the absence of heat, is selected.

Encapsulated and cold pressure fixable toner compositions are known. Cold pressure fixable toners have a number of advantages in comparison to toners that are fused by heat, primarily relating to the utilization of less energy since the toner compositions used can be fused at room temperature. Nevertheless, many of the prior art cold pressure fixable toner compositions suffer from a number of deficiencies. For example, these toner compositions must usually be fixed under high pressure, which has a tendency to severely disrupt the toner fixing characteristics of the toner selected. This can result in images of low resolution, or no images whatsoever. The preparative processes of the prior art pressure fixing toner compositions employ relatively high temperatures of from about 70° C. to about 95° C. to permit the free-radical core polymerization to proceed. The process of this invention utilizes a metathesis core forming process, thus allowing the core resin formation to be accomplished in embodiments at ambient temperature, hence reducing the energy consumption for the toner preparation and reducing the toner manufacturing costs. Also, with some of the prior art cold pressure toner compositions substantial image smearing can result from the high pressures used. The high fixing pressure also gives rise to glossy images and objectionable paper calendering problem. Additionally, the preparative processes of the prior art pressure fixing toner compositions employed relatively large quantities of organic solvents as the reaction media, and these solvents could drastically increase the toner's manufacturing cost because of the expensive solvent separation and recovery procedure, and the necessary precautions that have to be undertaken to prevent the solvent associated hazards. Moreover, the involvement of organic solvent in the prior art processes also decreases the product yield per unit volume of reactor size. In addition, the large amount of solvents used in many prior art processes also have deleterious effects on toner particle morphology and bulk density as a result of their removal from the toner particles during the toner Isolation stage, thus causing shrinkage or collapse of the toner particles, resulting in a toner of very low bulk density, which disadvantages are substantially eliminated with the process of the present invention. Furthermore, with many of the prior art processes narrow size dispersity toner particles cannot be easily obtained by conventional bulk homogenization techniques as contrasted with the process of the present invention wherein narrow size dispersity toner particles are obtained. More specifically, thus with the encapsulated toners of the present invention, control of the toner physical properties of both the core and shell materials can be desirably achieved. Specifically, with the encapsulated toners of the present invention undesirable leaching or loss of core components is avoided, and image ghosting is avoided or minimized. Image ghosting is a common phenomena in pressure fixing ionographic printing processes. This refers to the unwarranted repetitious generation of images, and is related to the contamination of dielectric receiver by residual toner materials which cannot be readily removed in the cleaning process. The result is the retention of some latent images on the dielectric receiver surface after cleaning, and the subsequent unwarranted development of these images. One of the common causes of image ghosting is related to the adherence of some residual toner material to the dielectric receiver during the image development process. In many of the prior art microencapsulation processes utilizing free radical polymerization for the formation of core resin, the resultant encapsulated toners often contain residual monomers, which monomers often leach out to the toner surface causing toner agglomeration as well as image ghosting when used in pressure transfixing ionographic printing processes. The core resin forming metathesis process of the present invention overcomes this disadvantage in that the core resin monomers or precursors are completely or substantially completely consumed in the formation of the core resin. Additionally, the preparative processes of the present invention in embodiments employs relatively ambient temperatures of from about 20° C. to about 60° C. and more preferably from about 20° C. to about 40° C. to enable the metathesis core resin forming process to proceed effectively.

In a patentability search report, there was recited the following prior art, all U.S. Pat. Nos.: U.S. Pat. No. 4,816,366 directed to a toner obtained by suspension polymerization wherein silane coupling agents may be selected, see column 3, beginning at line 6; also note the disclosure in column 3, beginning at line 56, wherein an inorganic fine powder, such as silicas, is attached to the surface of polymerizable monomer composition particles to effect stabilization thereof; note the preferred process method in column 5, beginning at line 59, and examples of silicone particles that may be selected, reference column 7, and silane coupling agents, see columns 7 and 8, for example; the use of polymerizable monomers with vinyl groups is disclosed, for example, in column 12, lines 27 to 62; and crosslinking agents such as divinylbenzene may also be selected, see column 13, lines 34 to 54, for example; U.S. Pat. No. 4,465,756 directed to encapsulated toners with improved chargeability comprising a pressure fixable adhesive core material containing a colorant and a pressure rupturable shell enclosing the core material, the outer surface of the shell being provided with the surface active agent with the hydrophobic group, reference columns 3 and 4; also note specifically the disclosures in columns 5 through 9; the use of a catalyst for the formation process, reference column 5, lines 45 to 46, for example; and interfacial polymerization techniques wherein there is reacted a hydrophobic liquid with a hydrophilic liquid for the purpose of forming toner shells, reference for example column 5, lines 47 to 56; U.S. Pat. No. 4,626,489 directed to a polymerizable mixture containing a monomer, a polymerization initiator and a colorant, which mixture is subjected to suspension polymerization, and wherein an additional monomer Is absorbed onto the resulting polymer particles, reference the Abstract of the Disclosure; also note columns 3 to 8; the use of crosslinking agents having two or more polymerizable double bonds such as divinyl ether, reference column 3, lines 45 to 57, for example, and the use of silane coupling agents to treat magnetic material which may be incorporated into the polymerizable mixture, reference for example column 4, lines 44 to 46; and U.S. Pat. No. 4,727,011 directed to an improved process for the preparation of encapsulated toner compositions which comprises mixing in the absence of a solvent a core monomer and initiator pigment particles, a first shell monomer stabilizer in water, and accomplishing other steps including effecting a free radical polymerization of the core monomer in an interfacial polymerization reaction between a first and second shell monomer, reference the Abstract of the Disclosure, for example; note the illustrative examples of core monomers in column 6, beginning at line 21, and the examples of pigments in column 6, beginning at line 46, or examples of shell monomers are outlined, for example, in column 7, beginning at line 23. Also mentioned are U.S. Pat. Nos. 4,761,358; 3,893,933 and 4,601,968, which relate to encapsulated toners and interfacial polymerization processes in some instances.

With further reference to the prior art, there are disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. Furthermore, there are disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent.

Accordingly, there is a need for preparative processes and encapsulated toner compositions with many of the advantages illustrated herein. Specifically, there is a need for simple and economical processes for encapsulated toners, which permit a wide selection of shell and core resin materials. Another need resides in the provision of an interfacial polymerization/metathesis process for black and colored encapsulated toner compositions comprising a hard polymeric shell and a soft core comprised of core resin and colorants, and wherein organic solvents are eliminated in their preparation in some embodiments. Another specific need is to provide encapsulated toner compositions comprising a core of a polyolefinic-containing core resin obtained by metathesis of olefins and colorants, and encapsulated thereover a polymeric shell coating. Also, there is a need to provide encapsulated toner compositions, including colored toners wherein image ghosting and the like is eliminated or minimized. An additional need is to provide pressure fixable encapsulated toners which offer quality images with excellent fixing levels, for example, over 70 percent at low fixing pressure of, for example, 2,000 psi. Furthermore, there is a need for encapsulated toners, including colored toners with excellent release characteristics enabling their selection in imaging systems without the use of surface release fluids such as silicone oils to prevent image offsetting to the fixing or fuser roll. Another need is to provide encapsulated toners, including colored toners with substantially no toner agglomeration, long shelf life exceeding, for example, one year, and wherein the core resin is a silane-containing polymer such as that derived. from the metathesis ring opening polymerization of silacyclopentene yielding a linear unstaturated polymer containing silane units in the backbone, and which imparts excellent release properties to the toners without the need of additional release agents such as polysiloxanes. Also, there is a need for encapsulated toners comprised of a core comprised of a resin formed by a metathesis reaction, pigment or dye and encapsulated by a cellulose shell material such as hydroxyethyl cellulose coating formed by precipitation thereof. There is also a need for enhanced flexibility in the design and selection of the core materials for encapsulated toners as well as permitting flexibility in the control of the toner physical properties such as the bulk density, particle size, and size dispersity.

SUMMARY OF THE INVENTION

It is an object of the present invention to provide encapsulated toner processes with many of the advantages illustrated herein.

In another object of the present invention there are provided simple and economical processes for black and colored toner compositions by an interfacial polymerization/metathesis process in which the shell is formed by interfacial polymerization, and the core resin is obtained by a metathesis reaction.

In another object of the present invention there are provided simple and economical processes for black and colored toner compositions by a process in which the shell is formed by the precipitation of surfactant, such as a cellulose material, and the core resin is obtained by a metathesis reaction.

In a further object of the present invention there is provided a process for the preparation of encapsulated toner comprised of a core of a polymer resin obtained by metathesis, pigments and/or dyes, and thereover a polymeric shell prepared, for example, by interfacial polymerization.

In another object of the present invention there is provided a process for encapsulated toner compositions comprised of a polycyclic or acyclic-containing core resin prepared by metathesis process.

Another object of the present invention is to provide an encapsulated toner process wherein the core forming metathesis reaction is performed at about 20° C. to about 60° C.

Additionally, in another object of the present invention there is provided a core resin forming metathesis accomplished at ambient temperatures.

These and other objects of the present invention are accomplished in embodiments by the provision of toners, and more specifically, encapsulated toners and processes thereof. In one embodiment of the present invention there are provided encapsulated toners with a soft core containing a polymer resin, a colorant, and a polymeric shell thereover. Specifically, in one embodiment there are provided in accordance with the present invention encapsulated toners comprised of a core containing a polymer resin obtained by metathesis, pigment particles, dyes, or mixtures thereof, and thereover a shell preferably obtained by interfacial polymerization. In another embodiment of the present invention there are provided encapsulated toners with a core containing a polymer resin, a colorant, and a polymeric shell thereover such as hydroxymethyl cellulose. Specifically, in one embodiment there are provided in accordance with the present invention encapsulated toners comprised of a core containing a polymer resin obtained by metathesis, pigment particles, dyes, or mixtures thereof, and thereover a shell preferably obtained by precipitation.

The aforementioned process of the present invention comprises in embodiments an interfacial polymerization/metathesis process, which comprises (1) mixing or blending of a cyclic olefinic component or components, colorants, and a shell monomer component or components; (2) dispersing the resulting mixture by high shear blending, such as a Brinkman Polytron at a speed of from about 4,000 to 8,000 revolutions per minute, into stabilized microdroplets in an aqueous medium with the assistance of suitable dispersants or emulsifying agents; (3) thereafter subjecting the aforementioned stabilized microdroplets to a shell forming interfacial polycondensation; and (4) subsequently forming the core resin by the addition of an inorganic or organometallic catalyst, and heating at ambient or elevated temperature, such as from between about 20° C. to about 60° C., within the newly formed microcapsules. The shell forming interfacial polycondensation is generally accomplished at ambient temperature, but elevated temperatures may also be employed depending on the nature and functionality of the shell monomer selected. For the core polymer resin forming metathesis, the process is generally effected at a temperature of from ambient temperature to about 90° C., and preferably from ambient temperature to about 40° C. In addition, more than one catalyst may be utilized to enhance the metathesis reaction, and to generate the desired molecular weight and molecular weight distribution. Catalysts such as ruthenium trichloride, rhenium chloride, lithium aluminumhydride activated molybdenum oxide, ruthenium oxide, tungsten oxide, alumina supported cobaltoxide-molybdenum oxide or those prepared from a transitional metal halide compound such as tungsten hexachloride, molybdenum pentachloride, or rhenium trichloride or an organometallic compound such as tetraalkyltin or dialkylaluminum in an amount of from, for example, about 0.01 percent to 10 percent, and preferably from about 0.01 to about 1 percent by weight of the core monomer are usually employed, and wherein alkyl contains from 1 to about 20 carbon atoms, like methyl, ethyl, propyl, butyl, hexyl, octyl, and the like.

The aforementioned process of the present invention can also be comprised of a precipitated shell polymer and a core obtained by a metathesis process by (1) mixing or blending of a cyclic olefinic component or components, an Inorganic or organometallic catalyst, and colorants; (2) dispersing the resulting mixture by high shear blending, such as a Brinkman Polytron at a speed of from about 4,000 to 8,000 revolutions per minute, into stabilized microdroplets in an aqueous medium with the presence of suitable surfactant such as hydroxyethyl cellulose; and (3) thereafter adding the inorganic or organometallic catalyst forming the core resin by metathesis at ambient or elevated temperature within the newly formed microcapsules. The shell forming precipitating step is believed to occur during the dispersion step, but elevated temperatures may also be employed to precipitate the cellulose material on the microdroplet depending on the nature and functionality of the surfactant monomer selected. For the core polymer resin forming metathesis, the process is generally effected at a temperature of from ambient temperature to about 60° C., and preferably from ambient temperature to about 40° C.

Illustrative specific examples of the cyclic olefinic reactants selected for the core resin forming metathesis include cyclic olefin aliphatic or alkenyls such as norbornene, alkyl nornbornenes, like methyl nornbornene, ethyl nornbornene, propyl nornbornene, butyl nornbornene, pentyl nornbornene and the like; alkoxy nornbornenes like methoxy nornbornene, ethoxy nornbornene, propoxy nornbornene and the like, hydroxy nornbornene, chloro nornbornene, bromo nornbornene, disubstituted nornbornenes such as dimethyl nornbornene and the like, acetyl nornbornene, carbamethoxy nornbornene, dimethylcarbamido nornbornene, norbanediene, substituted norbanediene and the like, cyclopropene, methyl cyclopropene, dimethyl cyclopropene, ethyl cyclopropene, diethyl cyclopropene, cyclobutene, cyclopentene, 3-methylcyclopentene cyclopentadiene, cyclohexene, substituted cyclohexenes such as 3-methylcyclohexene or 4-methylcyclohexene, and disubstituted such as 1,2-dimethylcyclohexene, cyclohexadiene, cycloheptene, cycloheptadiene, cyclooctene, substituted cyclooctene, such as methyl or dimethyl cyclooctene, cyclooctadiene, substituted cycloctadiene such as 1-methyl-1,5-cyclooctadiene or 1-ethyl-1,5-cyclooctadiene or chloro cyclooctadiene and the likes, cyclooctatetrene and substituted cyclooctatetrene, deltacyclene, acetylene, butadiene, cyclododecene, dicyclopentadiene, 1,3-cyclopentylenevinylene, bicyclo[5,5,0]oct-2-ene, silacyclopentene, mixtures thereof and the like. An effective amount of the olefinic reagent that can be selected for the metathesis is, for example, from 10 to about 99 weight percent, and preferably from 20 to about 99 weight percent of the toner components.

Illustrative specific examples of acyclic olefinic reactants selected for the core resin forming metathesis include alkenyls of from about 2 to about 24 carbon chains, such as hexane, heptene, butadiene, octene, hexadiene, heptadiene, octadiene, cyclopentadiene, divinylether, diallylether, dibutenylether, dipentenylether, dihexenylether, diheptenylether, dioctenylether, vinylbutenylether, vinylhexenylether, allylbutenylether, allylhexenylether, divinylbenzene, diallylbenzene, divinyltoluene, diallyltoluene, divinylnaphthalene, dlallylnaphthalene, bis(vinyloxy)benzene, bis(allyloxy)benzene, bis(vinyloxy)toluene, divinyl succinate, divinyl malonate, divinyl glutarate, divinyl adipate, divinyl pimelate, divinyl suberate, divinyl methylglutarate, methyladipate, diallyl succinate, diallyl glutarate, diallyl adipate, poly(butadiene), styrene-butadiene, mixtures thereof and the like. An effective amount of the acyclic olefinic reagent that can be selected for the metathesis is, for example, from 10 to about 99 weight percent, and preferably from 20 to about 99 weight percent of the toner components.

The catalysts that can be utilized for the core resin forming metathesis include metal halides such as ruthenium trichloride, ruthenium trichloride trihydrate, ruthenium tribromide, ruthenium triiodide, tungsten hexachloride, tungsten hexabromide, tungsten hexaiodide, molybdenum chloride, molybdenum bromide, molybdenum iodide, molybdenum oxide, ruthenium oxide, tungsten oxide, tantalum chloride, tantalum bromide, tantalum iodide, tantalum oxide, a tetraalkyl complex of tungsten halides such as chlorides, bromides or iodides complexes of tetramethyl tungsten, tetraethyl tungsten, tetrapropyl tungsten, and the like, molybdenum halides, tantalium halides, rhenium halides, ruthenium halides and the like, lithium aluminum hydride activated molybdenum oxide, alumina supported rhenium oxide, alumina supported cobalt oxide-molybdenum oxide, rhenium pentachloride, rhenium pentabromide, rhenium pentaiodide, organometallic catalysts such as trialkyl aluminum or dialkyl aluminum chloride complexes of rhodium halides, tungsten halides, molybdenum halides, ruthenium halides, mixture thereof and the like. The catalyst is employed in effective amounts of, for example, from about 0.01 to about 10 weight percent and preferably from about 0.01 to about 1 weight percent.

Various known colorants present in the core in an effective amount of, for example, from about 1 to about 65 percent by weight of toner, and preferably in an amount of from about 1 to about 60 weight percent, that can be selected include carbon black, like REGAL 330® magnetites, such as Mobay magnetites M08029 TM, M08060, TM; Columbian magnetites; MAPICO BLACKS TM and surface treated magnetites; Pfizer magnetites, CB4799 TM, CB5300 TM, CB5600 TM, MCX6369 TM; Bayer magnetites, BAYFERROX 8600 TM, 8610 TM; Northern Pigments magnetites, NP-604 TM, NP-608 TM; Magnox magnetites TMB-100 TM, or TMB-104 TM; and other equivalent black pigments. As colored pigments there can be selected HELIOGEN BLUE L6900 TM, D6840 TM, D7080 TM, D7020 TM, PYLAM OIL BLUE TM and PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAperm YELLOW FGL TM, HOSTAPERM PINK E TM from Hoechst, and CINQUASIA MAGENTA TM available from E.I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK TM, and cyan components may also be used as pigments with the process of the present invention, and is employed from effective amounts of from about 1 weight percent to about 65 weight percent of the toner.

Examples of shell polymers include polyureas, polyamides, polyesters, polyurethanes, mixtures thereof, and other polycondensation products. The shell amounts are generally from about 5 to about 30 weight percent of toner, and have a thickness generally, for example, of less than about 5 microns, and more specifically from about 0.1 micron to about 3 microns. Other shell polymers, shell amounts, and thicknesses can be selected provided the objectives of the present invention are achievable.

The shell forming monomer components present in the organic phase are generally comprised of diisocyanates, diacyl chloride, bischloroformate, together with appropriate polyfunctional crosslinking agents such as triisocyanate, triacyl chloride and other polyisocyanates. Illustrative examples of the shell monomer components include benzene diisocyanate, toluene diisocyanate, diphenylmethane diisocyanate, cyclohexane diisocyanate, hexane diisocyanate, adipoyl chloride, fumaryl chloride, suberoyl chloride, succinyl chloride, phthaloyl chloride, isophthaloyl chloride, terephthaloyl chloride, ethylene glycol bischloroformate, and diethylene glycol bischloroformate. The water soluble shell forming monomer components, which are added to the aqueous phase, can be a polyamine or polyol including bisphenols, the nature of which is dependent on the desired shell materials for the desired applications. Illustrative examples of water soluble shell monomers include ethylenediamine, triethylenediamine, diaminotoluene, diaminopyridine, bis(aminopropyl)piperazine, bisphenol A, bisphenol Z, and the like. If desired, a water soluble crosslinking agent, such as triamine or triol, can also be added to improve the mechanical strength of shell structure. Illustrative shell materials are detailed in U.S. Pat. No. 5,013,630 (D/89070) and U.S. Pat. No. 5,023,159 (D/89071), both entitled Encapsulated Toner Compositions, the disclosures of which are totally incorporated herein by reference.

Examples of shell precipitated polymers which are also used as the surfactant or dispersant include cellulose, methyl cellulose, methylethyl cellulose, hydroxyethyl cellulose, hydroxymethyl cellulose, hydroxypropyl cellulose, hydroxybutyl cellulose, polyvinylalcohol, polyvinyl acetate, polyacrylic acid, anionic surfactants, such as sodium dodecyl sulfonate, potassium dodecyl sulfonate, sodium dodecylbenzene sulfonate, cationic surfactants, such as dialkylbenzenetrialkyl ammonium chloride mixture thereof and the like, and are employed in an effective amount of, for example, from about 0.1 weight percent to about 5 weight percent of the toner.

In one embodiment of the present invention, there is provided a process for the preparation of encapsulated toner compositions, which process comprises (i) mixing a core comprised of about one mole percent by weight of toner of a cyclic monomer such as nornbornene, and a pigment such as HELIOGEN BLUE TM in amounts of from about 0.05 mole percent by weight of toner; (ii) dispersing the said monomer in an aqueous solution containing one percent by weight of methyl ethylhydroxy cellulose (TYLOSE®) and optionally a 0.01 percent to about 0.05 percent of sodium dodecylsulfate, utilizing a high shear mixer such as an IKA T-50 disperser at about 8,000 revolutions per minute for a duration of from about 60 seconds to 120 seconds; (iii) followed by the addition of a catalyst, such as ruthenium (III) chloride, in amounts of from about 0.001 to about 0.01 percent by weight of toner; and (Iv) thereafter heating to about 40° C. to effect the core forming metathesis reaction for a duration of about 8 hours. The encapsulated toners obtained can then be washed with water four times by centrifugation, and dried by fluidization in a fluid bed dryer operated at ambient temperature for a duration of three hours. The volume average particle size of the toner ranges from about 5 microns to about 30 microns as measured by the Coulter Counter, and its volume average droplet size dispersity ranges from about 1.2 to about 1.4 as inferred from the Coulter Counter measurements of the microcapsule particles. The particle size may be controlled by the amount of surfactants. Generally, utilizing an aqueous solution of about 0.5 to about 0.75 percent of TYLOSE® yields particle sizes of from about 8 microns to about 15 microns, utilizing an aqueous solution of one percent of TYLOSE® yields particle sizes of from about 6 microns to about 8 microns, and alternatively, utilizing an aqueous solution of one percent of TYLOSE® and 0.01 percent of sodium dodecylsulfate yields particle sizes of from about 4 microns to about 6 microns.

Precipitated processes selected for the shell formation of the toners of the present invention are as illustrated, for example, in patent applications U.S. Ser. No. 720,300 (D/90516), U.S. Ser. No. 828,620 (D/91415), U.S. Ser. No. 834,093 (D/91427), the disclosures of which are totally incorporated herein by reference. These processes generally involve the precipitation of surfactant materials such as polyvinyl alcohol, methylalkyl cellulose or hydroxyalkyl cellulose, or polyacrylic acid onto the core surfaces.

Interfacial polymerization processes selected for the shell formation of the toners of the present invention are as illustrated, for example, in U.S. Pat. Nos. 4,000,087 and 4,307,169, the disclosures of which are totally incorporated herein by reference. These processes generally involve the interfacial condensation of a shell monomer present in the oil dispersed phase such as an isocyanate or diacid chloride, and a second shell monomer present in the aqueous phase such as a diamine or alcohol, thereby forming a polymer shell such as a polyester, polyamide, polyurethane and the like.

Surface additives that can be added to the toner compositions of the present invention include, for example, metal salts, metal salts of fatty acids, colloidal silicas, mixtures thereof and the like, which additives are usually present in an amount of from about 0.1 to about 1 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from DeGussa Inc.

Also, the toner compositions can be rendered conductive with, for example, a volume resistivity of from about $1\times10^3$ ohm-cm to about $1\times10^8$ ohm-cm by adding to the surface thereof in effective amounts of, for example, from about 1 to about 35 weight percent by, for example, known blending and mixing processes, components such as carbon blacks, such as REGAL 330®, BLACK PEARL 2000®, graphite, copper iodide, and other conductive metal salts, conductive organic or organometallic materials.

Percentage amounts of components are based on the total toner components unless otherwise indicated.

The following Examples are being submitted to further define various species of the present invention. These Examples are intended to be illustrative only and are not intended to limit the scope of the present invention. Also, parts and percentages are by weight unless otherwise indicated.

EXAMPLE I

A pressure fixable encapsulated toner comprised of a polycyclooctene core resin, BAYFERROX TM magnetite pigment, and a polyurea shell, which toner is suitable for ionographic systems, was prepared as follows:

Cyclooctene (100 grams) and ISONATE 143-L TM (Dow Chemical) (47.1 grams) were mixed in a 2 liter container with a Brinkmann polytron equipped with a PT 35/4 probe at 4,000 rpm for 30 seconds. BAYFERROX TM magnetite 8610 obtained from Bayer (300 grams) was then added, and the resulting mixture was homogenized by high sheer blending with the Brinkmann polytron at 8,000 rpm for 3 minutes. To the mixture was then added one liter of 0.12 percent aqueous poly(vinyl alcohol) (88 percent hydrolyzed; $M_w$, molecular weight average of 96,000) solution, and thereafter, the mixture was blended at 9,000 rpm with an IKA polytron equipped with a T45/4G probe for 2 minutes. A solution of 1,4-bis(3-aminopropyl)piperazine (33 grams) and water (80 milliliters) was then added with constant stirring for 10 minutes to initiate the microcapsule shell forming reaction. Subsequently, the mixture was transferred to a 2 liter reaction kettle and was mechanically stirred at room temperature for approximately 1 hour to complete the shell forming polycondensation reaction. Thereafter, ruthenium chloride (1 gram) was added and the mixture was heated in an oil bath to initiate the core binder-forming metathesis. The temperature of the mixture was gradually increased from room temperature, about 25° C., to a final temperature of 60° C. over a period of 5.5 hours. Stirring was then continued for an additional 6 hours after which the mixture was cooled to room temperature (25° C.) and transferred to a 4 liter beaker, and washed repeatedly with water until the washing was clear. The wet toner was sieved through a 180 micron sieve to remove coarse material, transferred to a 2 liter beaker, and diluted with water to a total volume of 1.8 liters. Colloidal graphite (22.7 grams, millimole), AQUADAG E TM available from Acheson Colloids, diluted with 100 millimiters of water was added to the wet toner, and the mixture was spray dried in a Yamato Spray Dryer at an air inlet temperature of 160° C., and an air outlet temperature of 80° C. The air flow was retained at 0.75 $m^3$/minute, while the atomizing air pressure was kept at 1.0 killigram per centimeter squared ($kg/cm^2$). The collected encapsulated dry toner (354 grams) comprised of about 24 percent by toner weight of poly(cyclooctene) core, 60 percent by toner weight of BAYFERROX TM pigment, and 16 percent by toner weight of polyurea shell was screened through a 63 micron sieve, and particle size measurement by Coulter Counter provided a volume average particle diameter of 12 microns with a volume average particle size dispersity of 1.35.

Two hundred and forty (240) grams of the above prepared toner was dry blended using a Greey blender, first with 0.96 gram of carbon black (BLACK PEARLS TM 2000) for 2 minutes with the blending impeller operating at 3,500 RPM, and then with 3.6 grams of zinc stearate for another 6 minutes at the impeller speed of 3,000 RPM. The volume resistivity of the resulting toner was $5\times10^6$ ohm-cm. This toner was then evaluated in a Delphax S6000 printer with a dielectric receiver temperature of 55° C. and a transfix pressure of 2,000 psi. Print quality was evaluated from a checkerboard print pattern and image ghosting was examined visually. The image optical density was measured using a standard integrating densitometer. The toner of this Example provided an image fix level of 81 percent with clean image background and without image ghosting. This toner also displayed excellent powder flow characteristics, and did not agglomerate even after heating to 55° C. for 48 hours.

EXAMPLE II

A pressure fixable encapsulated toner comprised of a polycyclooctadiene core resin, BAYFERROX TM pigment and polyurea shell suitable for ionographic application was prepared as follows:

Cyclooctadiene (100 grams) and ISONATE 143-L TM (47.0 grams) were mixed in a 2 liter container with a Brinkmann polytron equipped with a PT 35/4 probe at 4,000 rpm for 30 seconds. BAYFERROX T TM magnetite 8610 obtained from Bayer (300 grams) was then added, and the resulting mixture was homogenized by high sheer blending with the Brinkmann polytron at 8,000 rpm for 3 minutes. To the mixture was then added one liter of 0.12 percent aqueous poly(vinyl alcohol) (88 percent hydrolyzed; $M_w$, molecular weight average of 96,000) solution, and thereafter, the mixture was blended at 9,000 rpm with an IKA polytron equipped with a T45/4G probe for 2 minutes. A solution of 1,4-bis(3-aminopropyl)piperazine (33 grams) and water (80 milliliters) was added over a period of 10 minutes with constant stirring. Subsequently, the mixture was transferred to a 2 liter reaction kettle and was mechanically stirred at room temperature for approximately 1 hour to complete the shell forming polycondensation reaction. Thereafter, ruthenium chloride (1 gram) was added and the mixture was heated in an oil bath to initiate the core binder-forming hydrosilylation. The temperature of the mixture was gradually raised from room temperature to a final temperature of 60° C. over a period of 5.5 hours. Stirring was continued for an additional 6 hours after which the mixture was cooled to room temperature, and the resulting toner product was transferred to a 4 liter beaker, and was washed repeatedly with water until the washing was clear. The wet toner was then sieved through a 180 micron sieve to remove coarse material, and then transferred to a 2 liter beaker and diluted with water to a total volume of 1.8 liters. Colloidal graphite (22.7 grams), AQUADAG E TM, available from Acheson Colloids, diluted with 100 milliliters of water was added to the beaker, and the mixture was spray dried in a Yamato Spray Dryer at an air inlet temperature of 160° C., and an air outlet temperature of 80° C. The air flow was retained at 0.75 $m^3$/minute, while the atomizing air pressure was kept at 1.0 kg/$cm^2$. The encapsulated collected dry toner (330 grams) comprised of about 24 percent by toner weight of poly(cyclooctadiene) core, 60 percent by toner weight of BAYFERROX T TM pigment and 16 percent by toner weight of polyurea shell, was screened through a 63 micron sieve, and Coulter Counter measurement provided a volume average particle diameter of 18 microns with a volume average particle size dispersity of 1.38.

Two hundred and forty (240) grams of the above toner were dry blended and evaluated by repeating the procedure of Example I. The toner of this Example provided a high image fix level of 78 percent with clean image background and without image ghosting. This toner also displayed excellent powder flow characteristics, and did not agglomerate even after heating to 55° C. for 48 hours.

EXAMPLE III

A pressure fixable encapsulated toner comprised of a poly(1-methyl-1,5-cyclooctadiene)core resin, BAYFERROX TM pigment and polyurea shell suitable for ionographic application was prepared as follows:

1-methyl-1,5-Cyclooctadiene (100 grams) and ISONATE 143-L TM (47.0 grams) were mixed in a 2 liter container with a Brinkmann polytron equipped with a PT 35/4 probe at 4,000 rpm for 30 seconds. MAPICO BLACK TM pigment obtained from Columbian Chemical (300 grams) was added, and the resulting mixture was homogenized by high sheer blending with the Brinkmann polytron at 8,000 rpm for 3 minutes. To the mixture was added one liter of 0.12 percent aqueous poly(vinyl alcohol) (88 percent hydrolyzed; $M_w$, molecular weight average of 96,000) solution, and thereafter, the mixture was blended at 9,000 rpm with an IKA polytron equipped with a T45/4G probe for 2 minutes. A solution of 1,4-bis(3-aminopropyl)piperazine (33.0 grams) and water (80 milliliters) was then added over a period of 10 minutes with constant stirring. Subsequently, the mixture was transferred to a 2 liter reaction kettle and was mechanically stirred at room temperature for approximately 1 hour to complete the shell forming polycondensation reaction. Thereafter, the mixture was heated in an oil bath to initiate the core binder-forming hydrosilylation. The temperature of the mixture was gradually increased from room temperature to a final temperature of 90° C. over a period of 5.5 hours. The wet toner obtained was washed and spray dried in accordance with the procedure as described in Example I. The collected dry toner (328.0 grams) comprised of about 24 percent by toner weight of poly(1-methyl-1,5-cyclooctadiene) core, 60 percent by toner weight of BAYFERROX TM pigment and 16 percent by toner weight of polyurea shell was screened through a 63 micron sieve, and particle size measurement by Coulter Counter gave a volume average particle diameter of 17 microns with a volume average particle size dispersity of 1.30.

Two hundred and forty (240) grams of the above toner were dry blended and machine evaluated in accordance with the procedure of Example I. This toner provided an image fix level of 81 percent without image ghosting or background. In addition, the toner displayed excellent powder flow properties, and did not agglomerate on standing for 48 hours at 55° C.

EXAMPLE IV

A pressure fixable encapsulated toner comprised of a copoly(1-methyl-1,5-cyclooctadiene)-copolycyclooctene core resin, BAYFERROX TM pigment and polyurea shell suitable for ionographic application was prepared as follows:

Cyclooctene (50 grams), 1-methyl-1,5-cyclooctadiene (50 grams) and ISONATE 143-L TM (47.0 grams) were mixed in a 2 liter container with a Brinkmann polytron equipped with a PT 35/4 probe at 4,000 rpm for 30 seconds. BAYFERROX 8610 TM magnetite (300 grams) was then added, and the resulting mixture was homogenized by high sheer blending with the Brinkmann polytron at 8,000 rpm for 3 minutes. To the mixture was added one liter of 0.12 percent aqueous poly(vinyl alcohol) (88 percent hydrolyzed; $M_w$, molecular weight average of 96,000) solution, and thereafter, the mixture was blended at 9,000 rpm with an IKA polytron equipped with a T45/4G probe for 2 minutes. A solution of 1,4-bis(3-aminopropyl)piperazine (33.0 grams) and water (80 milliliters) was then added over a period of 10 minutes with constant stirring. Subsequently, the mixture was transferred to a 2 liter reaction kettle and was mechanically stirred at room temperature for approximately 1 hour to complete the shell forming polycondensation reaction. Thereafter, ruthenium (III) chloride (1 gram) was added and the mixture was heated in an oil bath to initiate the core binder-forming hydrosilylation. The temperature of the mixture was gradually raised from room temperature to a final temperature of 90° C. over a period of 5.5 hours. The wet toner obtained was washed and spray dried by repeating the procedure as described in Example I. The collected dry toner (305.0 grams) comprised of about 24 percent by toner weight of copoly(1-methyl-1,5-cyclooctadiene)copolycyclooctene core, 60 percent by toner weight of BAYFERROX TM pigment and 16 percent by toner weight of polyurea shell was screened through a 63 micron sieve; and particle size measurement by Coulter Counter provided a volume average particle diameter of 15 microns with a volume average particle size dispersity of 1.42.

Two hundred and forty (240) grams of the above encapsulated toner was dry blended and machine evaluated by repeating the procedure as described in Example I. For this toner, an image fix level of 67 percent was obtained, together with clean image background and no image ghosting. This toner also displayed excellent powder flow characteristics, and did not agglomerate even after heating to 55° C. for 48 hours.

EXAMPLE V

A heat fusible encapsulated toner comprised of a poly(nornbornene) core resin, HELIOGEN BLUE TM pigment and TYLOSE ® shell for xerographic application was prepared as follows:

Nornbornene (300 grams) and HELIOGEN BLUE TM obtained from BASF (9 grams) was ball milled for 48 hours. A portion of this mixture (250 grams) was added to 600 grams of an aqueous solution containing one percent of TYLOSE ® and 0.005 percent of sodium dodecyl sulfate. The mixture was then homogenized using an IKA polytron equipped with a T45/4G probe for 2 minutes. To this was then added ruthenium chloride (1.5 grams) and the mixture was heated in an oil bath to initiate the core binder-forming metathesis. The temperature of the mixture was gradually increased from room temperature to a final temperature of 60° C. over a period of 5.5 hours. The wet toner so obtained was washed and fluid bed dried in accordance with the procedure of Example I. The collected dry toner (225 grams) comprised of about 96.7 percent by toner weight of poly(nornbornene), 3.3 percent by toner weight of pigment and about 0.1 percent by toner weight of methyl ethylhydroxy cellulose was screened through a 63 micron sieve, and particle size measurement by Coulter Counter provided a volume average particle diameter of 6.9 microns with a volume average particle size dispersity of 1.33.

Two hundred (200) grams of the above encapsulated toner were dry blended with 1 gram of AEROSIL R812 ® and 1.6 grams of tin oxide. A developer comprised of three parts of this toner with 97 parts of nickel-zinc ferrite carrier coated with a methyl terpolymer (styrene, methyl methacrylate, and a silane, reference U.S. Pat. No. 3,526,533, the disclosure of which is totally incorporated herein by reference) was prepared. The corresponding tribo was found to be −22 microcoulombs per gram. Images were then generated using a Xerox 5028 color printer and the images fused at 160° C. For the toner of this Example, the fixed images were of excellent quality. In addition, the toner displayed excellent powder flow of about 16 percent cohesion as measured by the HOSOKAWA TM powder tester, and did not agglomerate on standing for 48 hours at 55° C.

EXAMPLE VI

A heat-fusible encapsulated toner comprised of a poly(nornbornene) core resin, HELIOGEN BLUE TM pigment and TYLOSE ® shell for xerographic application was prepared as follows:

Nornbornene (300 grams) and HELIOGEN BLUE TM obtained from BASF (9 grams) were ball milled for 48 hours. A portion of this mixture (250 grams) was added to 600 grams of an aqueous solution containing one percent of TYLOSE ® and 0.01 percent of sodium dodecyl sulfate. The mixture was then homogenized using an IKA polytron equipped with a T45/4G probe for 2 minutes. To this was then added ruthenium chloride (1.5 grams) and the mixture was heated in an oil bath to initiate the core binder-forming metathesis. The temperature of the mixture was gradually increased from room temperature to a final temperature of 60° C. over a period of 5.5 hours. The wet toner so obtained was washed and fluid bed dried in accordance with the procedure of Example I. The collected dry toner (225 grams) comprised of 96.7 percent by toner weight of poly(nornbornene), 3.3 percent by toner weight of pigment and about 0.1 percent by toner weight of TYLOSE ® was screened through a 63 micron sieve, and particle size measurement by Coulter Counter provided a volume average particle diameter of 5.2 microns with a volume average particle size dispersity of 1.34.

Two hundred (200) grams of the above encapsulated toner were dry blended with 1 gram of AEROSIL R812 ® and 1.6 grams of tin oxide. A developer comprised of three parts of this toner with 97 parts of a nickel-zinc ferrite coated with a methyl terpolymer was prepared. The corresponding tribo was found to be −28 microcoulombs per gram. Images were then generated using a Xerox 5028 color printer and the images fused at 160° C. For the toner of this example, the fixed images were of excellent quality. In addition, the toner displayed excellent powder flow of about 14 percent cohesion as measured by the HOSOKAWA TM powder tester, and did not agglomerate on standing for 48 hours at 55° C.

EXAMPLE VII

A heat-fusible encapsulated toner comprised of a copoly(dicyclopentadiene)-copoly(cyclooctene) core resin, FANAL PINK TM pigment and tylose shell for xerographic application was prepared as follows:

Dicyclopentadiene (150 grams), cycloctene (150 grams) and FANAL PINK TM obtained from Hoechst (12 grams) was ball milled for 48 hours. A portion of this mixture (250 grams) as added to 600 grams of an aqueous solution containing one pecent of TYLOSE ® and 0.005 percent of sodium dodecyl sulfate. The mixture was then homogenized using an IKA polytron equipped with a T45/4G probe for 2 minutes. To this was then added ruthenium chloride (1.5 grams) and the mixture was heated in an oil bath to initiate the core binder-forming metathesis. The temperature of the mixture was gradually increased from room temperature to a final temperature of 60° C. over a period of 5.5 hours. The wet toner so obtained was washed and fluid-bed dried in accordance with the procedure of Example I. The collected dry toner (215 grams) comprised of 96.7 percent by toner weight of copoly(dicyclopentadiene)-copoly(cyclooctene), 3.3 percent by toner weight of pigment and about 0.1 percent by toner weight of TYLOSE ® was screened through a 63 micron sieve, and particle size measurement by Coulter Counter provided a volume average particle diameter of 7.2 microns with a volume average particle size dispersity of 1.36.

Two hundred (200) grams of the above encapsulated toner were dry blended with 1 gram of AEROSIL R812 ® and 1.6 grams of tin oxide. A developer comprised of three parts of this toner with 97 parts of a nickel-zinc ferrite carrier coated with a methyl terpolymer carrier was prepared. The corresponding tribo was found to be −20 microcoulombs per gram. Images were then generated using a Xerox 5028 color printer and the images fused at 160° C. For the toner of this Example, the fixed images were of excellent quality. In addition, the toner displayed excellent powder flow of about 15 percent cohesion as measured by the HOSOKAWA TM powder tester, and did not agglomerate on standing for 48 hours at 55° C.

EXAMPLE VIII

A heat-fusible encapsulated toner comprised of a poly(carbomethoxy nornbordiene) core resin, YELLOW PIGMENT 17 TM, and TYLOSE ® shell for xerographic application was prepared as follows:

Carbomethoxy nornbornene (300 grams) and YELLOW PIGMENT 17 TM obtained from Hoechst (12 grams) was ball milled for 48 hours. A portion of this mixture (250 grams) was added to 600 grams of an aqueous solution containing one percent of TYLOSE ® and 0.005 percent of sodium dodecyl sulfate. The mixture was then homogenized using an IKA polytron equipped with a T45/4G probe for 2 minutes. To this was then added ruthenium chloride (1.5 grams) and the mixture was heated in an oil bath to initiate the core binder-forming metathesis. The temperature of the mixture was gradually increased from room temperature to a final temperature of 60° C. over a period of 5.5 hours. The wet toner so obtained was washed and fluid-bed dried in accordance with the procedure of Example I. The collected dry toner (235 grams) comprised of 96.7 percent by toner weight of poly(carbomethoxy nornbornene), 3.3 percent by toner weight of pigment and about 0.1 percent by toner weight of TYLOSE ® was screened through a 63 micron sieve, and particle size measurement by Coulter Counter provided a volume average particle diameter of 3.5 microns with a volume average particle size dispersity of 1.43.

Two hundred (200) grams of the above encapsulated toner were dry blended with 1 gram of AEROSIL R812 ® and 1.6 grams of tin oxide. A developer comprised of three parts of this toner with 97 parts of a nickel-zinc carrier coated with a methyl terpolymer was prepared. The corresponding tribo was found to be −12 microcoulombs per gram. Images were then generated using a Xerox 5028 color printer and the images fused at 160° C. For the toner of this Example, the fixed images were of excellent quality. In addition, the toner displayed excellent powder flow of about 10 percent cohesion as measured by the HOSOKAWA TM powder tester, and did not agglomerate on standing for 48 hours at 55° C.

The ferrite core selected for all the working Examples was a nickel-zinc ferrite coated with a methyl terpolymer, about 0.75 weight percent coating weight, and where the diameter of the carrier was about 225 microns, and which carrier can be obtained from Steward Chemicals.

Embodiments of the present invention include an in situ process for the preparation of toner compositions which comprises dispersing a mixture of a cyclic olefin or cyclic olefins, pigments, dyes or mixtures thereof in an aqueous medium containing a surfactant thereby forming a stable microdroplet suspension, and thereafter adding a catalyst to effect a metathesis polymerization of the cyclic olefin or olefins to form the toner resin; and a process for the preparation of encapsulated toners which comprises (1) dispersing a mixture of a cyclic olefin or cyclic olefins, a shell forming monomer, and pigments, dyes or mixtures thereof, in an aqueous medium containing a surfactant thereby forming a stable microdroplet suspension; (2) initiating and completing a shell forming interfacial polymerization by adding a water miscable shell precursor component; and (3) adding a catalyst to effect a metathesis polymerization of the cyclic olefin or olefins to form a core resin within the microcapsule by optionally heating the aforementioned reaction mixture from ambient temperature to about 60° C.

Other modifications of the present invention may occur to those skilled in the art subsequent to a review of the present application. The aforementioned modifications, including equivalents thereof are intended to be included within the scope of the present invention.

What is claimed is:

1. A process for the preparation of encapsulated toners consisting essentially of (1) dispersing by high shear blending a mixture of a cyclic olefin or cyclic olefins, a shell forming monomer, and pigments, dyes or mixtures thereof in an aqueous medium containing a surfactant thereby forming a stable microdroplet suspension; (2) initiating and completing a shell forming interfacial polymerization by adding a water miscible shell precursor component; and (3) adding a catalyst to effect a metathesis polymerization of the cyclic olefin or olefins to form a core resin by heating the aforementioned reaction mixture comprised of the components of (1), a water immiscible shell precursor component and a catalyst from ambient temperature to about 60° C.; and wherein said pigments, dyes or mixtures thereof are selected in an amount of from about 1 to about 65 percent by weight.

2. A process in accordance with claim 1 wherein the dispersion is accomplished at a temperature of from about 25° C. to about 35° C.

3. A process in accordance with claim 1 wherein the metathesis polymerization of the cyclic olefin is accomplished at a temperature of from about 20° C. to about 60° C.

4. A process in accordance with claim 1 wherein the dispersion is accomplished at a temperature of from about 25° C. to about 35° C. and the the shell interfacial polymerization is accomplished at a temperature of from about 20° C. to about 35° C.

5. A process in accordance with claim 1 wherein the shell interfacial polymerization component is selected from the group consisting of a polyureathane, a polyester, a polyamide, a polyether and a polyurea.

6. A process in accordance with claim 1 wherein the core resin is obtained by the metathesis of an olefin in the presence of an inorganic or organometallic catalyst.

7. A process in accordance with claim 1 wherein the cyclic olefin is a functionalized olefin selected from the group consisting of norbornene, methyl nornbornene, ethyl nornbornene, propyl nornbornene, butyl nornbornene, pentyl nornbornene, methoxy nornbornene, ethoxy nornbornene, propoxy nornbornene, hydroxy nornbornene, chloro nornbornene, bromo nornbornene, dimethyl nornbornene, acetyl nornbornene, carbamethoxy nornbornene, dimethylcarbamido nornbornene, norbanediene, cyclopropene, methyl cyclopropene, dimethyl cyclopropene, ethyl cyclopropene, diethyl cyclopropene, cyclobutene, cyclopentene, 3-methylcyclopentene cyclopentadiene, cyclohexene, 3-methylcyclohexene, 4-methylcyclohexene, 1,2-dlmethylcyclohexene, cyclohexadiene, cycloheptene, cycloheptadiene, cyclooctene, methyl cyclooctene, dimethyl cyclooctene, cyclooctadiene, 1-methyl-1,5-cyclooctadiene or 1-ethyl-1,5-cyclooctadiene, chloro cyclooctadiene, cyclooctatetrene, deltacyclene, acetylene, butadiene, cyclododecene, dicyclopentadiene, 1,3-cyclopentylenevinylene, bicyclo[5,5,0]oct-2-ene, silacyclopentene, hexene, heptene, butadiene, octene, hexadiene, heptadiene, octadiene, cyclopentadiene, divinylether, diallylether, dibutenylether, dipentenylether, dihexenylether, diheptenylether, dioctenylether, vinylbutenylether, vinylhexenylether, allylbutenylether, allylhexenylether, divinylbenzene, diallylbenzene, divinyltoluene, diallyltoluene, divinylnaphthalene, diallylnaphthalene, bis(vinyloxy)benzene, bis(allyloxy)benzene, bis(vinyloxy)toluene, divinyl succinate, divinyl malonate, divinyl glutarate, divinyl adipate, divinyl pimelate, divinyl suberate, divinyl methylglutarate, methyladipate, diallyl succinate, diallyl glutarate, diallyl adipate and mixture thereof.

8. A process in accordance with claim 1 wherein the metathesis catalyst is selected from the group consisting of molybdic acid, ruthenium trichloride, ruthenium trichloride trihydrate, ruthenium tribromide, ruthenium triiodide, tungsten hexachloride, tungsten hexabromide, tungsten hexaiodide, molybdenum chloride, molybdenum bromide, molybdenum iodide, molybdenum oxide, ruthenium oxide, tungsten oxide, tantalum chloride, tantalum bromide, tantalum iodide, tantalum oxide, tetraalkyl or tetraaryltin complex of tungsten halides, molybdenum halides, tantalim halides, rhenium halides, ruthenium halides, lithium aluminum hydryde activated molybdenum oxide, alumina supported rhenium oxide, alumina supported cobalt oxide-molybdenum oxide, rhenium pentachloride, rhenium pentabromide, rhenium pentaiodide, trialkyl aluminum and dialkyl aluminum chloride complexes of rhodium halides, tungsten halides, molybdenum halides, ruthenium halides, and mixture thereof.

9. A process in accordance with claim 1 wherein the surfactant is a cellulose, hydroxymethyl cellulose, hydroxyethyl cellulose, ethylmethyl cellulose, polyvinyl alcohol, polyacrylic acid, sodium dodecyl sulfate, polyvinyl alcohol or mixture thereof, and the metathesis catalyst is ruthenium (lll) chloride.

10. A process in accordance with claim 1 wherein the pigment is carbon black, magnetite, or mixtures thereof; cyan, yellow, magenta, or mixtures thereof; or red, green, blue, brown, or mixtures thereof.

11. A process in accordance with claim 1 wherein there is added to the encapsulated toner obtained the surface additives of metal salts, metal salts of fatty acids, silicas, or mixtures thereof.

12. A process in accordance with claim 11 wherein the surface additives are present in an amount of from about 0.1 to about 10 weight percent based on the percent by weight of the encapsulated toner.

13. A process in accordance with claim 11 wherein zinc stearate is selected as the surface additive.

14. A process in accordance with claim 1 wherein there is added to the encapsulated toner obtained conductive components.

15. A process in accordance with claim 14 wherein the conductive components are carbon black, graphite, or mixtures thereof.

16. A process in accordance with claim 1 wherein the toner has an average volume diameter of from about 5 to about 30 microns, and a geometric size distribution of from about 11 to about 20.

17. A process in accordance with claim 1 wherein the cyclic olefin resin component represents from 35 to about 95 weight percent based on the weight percent of the encapsulated toner, the colorants represent from 1 to about 65 weight percent based on the weight percent of the encapsulated toner; the surfactant represents from 0.01 to about 5 weight percent based on the weight percent of the encapsulated toner; and the catalyst is present in an effective amount of from about 0.01 to about 1 percent based on the weight percent of the encapsulated toner core resin.

18. A process in accordance with claim 1 wherein the toner product is subjected to washing, sieving, and drying.

19. A process in accordance with claim 1 wherein polymerization is effected by heating.

* * * * *